US010989032B2

(12) United States Patent
Ferguson et al.

(10) Patent No.: US 10,989,032 B2
(45) Date of Patent: Apr. 27, 2021

(54) WELL COMPLETION

(71) Applicant: THRU TUBING SOLUTIONS, INC., Oklahoma City, OK (US)

(72) Inventors: Andrew M. Ferguson, Moore, OK (US); Stanley W. Loving, Port Aransas, TX (US); Roger L. Schultz, Newcastle, OK (US); Mark S. Britton, Carter, OK (US); Brock W. Watson, Sadler, TX (US)

(73) Assignee: Thru Tubing Solutions, Inc., Newcastle, OK (US)

( * ) Notice: Subject to any disclaimer, the term of this patent is extended or adjusted under 35 U.S.C. 154(b) by 204 days.

(21) Appl. No.: 15/727,030

(22) Filed: Oct. 6, 2017

(65) Prior Publication Data

US 2018/0030822 A1 Feb. 1, 2018

Related U.S. Application Data

(62) Division of application No. 14/720,532, filed on May 22, 2015, now Pat. No. 9,810,051.
(Continued)

(51) Int. Cl.
*E21B 33/138* (2006.01)
*E21B 43/26* (2006.01)
*E21B 43/14* (2006.01)

(52) U.S. Cl.
CPC ..... *E21B 43/261* (2013.01); *E21B 33/138* (2013.01); *E21B 43/14* (2013.01)

(58) Field of Classification Search
None
See application file for complete search history.

(56) References Cited

U.S. PATENT DOCUMENTS 2,970,645 A 2/1961 Glass
3,028,914 A 4/1962 Flickinger
(Continued)

FOREIGN PATENT DOCUMENTS

CN 1443268 A 9/2003
WO 2009118512 A2 10/2009

OTHER PUBLICATIONS

Canadian Office Action dated Mar. 31, 2017 for CA Patent Application No. 2,933,578, 4 pages.
(Continued)

*Primary Examiner* — Charles R Nold
(74) *Attorney, Agent, or Firm* — Smith IP Services, P.C.

(57) ABSTRACT

A well completion method can comprise, in a single trip into a wellbore, the following steps being performed for each of multiple zones penetrated by the wellbore: abrasively perforating the zone with a tubing deployed perforating assembly, fracturing the perforated zone with flow from surface via a well annulus, and then plugging the fractured zone with a removable plug substance, the perforating assembly displacing in the wellbore while the fractured zone is being plugged. Another well completion method can comprise, in a single trip into a wellbore, the following steps being performed for each of multiple zones penetrated by the wellbore: perforating the zone using an abrasive perforator, then displacing the perforator in the wellbore away from the earth's surface, then fracturing the zone, and plugging the fractured zone with a flowable plug substance.

13 Claims, 13 Drawing Sheets

Related U.S. Application Data

(60) Provisional application No. 62/103,786, filed on Jan. 15, 2015, provisional application No. 62/082,299, filed on Nov. 20, 2014.

(56) References Cited

U.S. PATENT DOCUMENTS

| | | | | |
|---|---|---|---|---|
| 4,809,781 | A | 3/1989 | Hoefner | |
| 5,314,019 | A | 5/1994 | Honarpour | |
| 5,353,874 | A | 10/1994 | Manulik | |
| 5,390,741 | A | 2/1995 | Payton et al. | |
| 5,669,448 | A | 9/1997 | Minthorn et al. | |
| 5,890,536 | A | 4/1999 | Nierode et al. | |
| 5,934,377 | A | 8/1999 | Savage | |
| 6,070,666 | A | 6/2000 | Montgomery | |
| 6,394,184 | B2 | 5/2002 | Tolman et al. | |
| 6,520,255 | B2 | 2/2003 | Tolman et al. | |
| 6,543,538 | B2 | 4/2003 | Tolman et al. | |
| 6,695,057 | B2 | 2/2004 | Ingram et al. | |
| 7,225,869 | B2 | 6/2007 | Willett et al. | |
| 7,273,099 | B2 | 9/2007 | East, Jr. et al. | |
| 7,673,673 | B2 | 3/2010 | Surjaatmadja et al. | |
| 7,810,567 | B2 | 10/2010 | Daniels et al. | |
| 7,874,365 | B2 | 1/2011 | East, Jr. et al. | |
| 7,934,556 | B2 | 5/2011 | Clark et al. | |
| 8,066,059 | B2 | 11/2011 | Ferguson et al. | |
| 8,074,715 | B2 | 12/2011 | Rispler et al. | |
| 8,281,860 | B2 | 10/2012 | Boney et al. | |
| 8,646,529 | B2 | 2/2014 | Clark et al. | |
| 8,853,137 | B2 | 10/2014 | Todd et al. | |
| 8,887,803 | B2 | 11/2014 | East, Jr. et al. | |
| 2002/0007949 | A1* | 1/2002 | Tolman | E21B 33/124 166/308.1 |
| 2004/0055749 | A1* | 3/2004 | Lonnes | E21B 23/04 166/298 |
| 2004/0099418 | A1* | 5/2004 | Behrmann | E21B 21/00 166/312 |
| 2005/0082061 | A1 | 4/2005 | Nguyen et al. | |
| 2005/0211439 | A1 | 9/2005 | Willett et al. | |
| 2007/0261852 | A1* | 11/2007 | Surjaatmadja | E21B 43/114 166/298 |
| 2007/0284106 | A1 | 12/2007 | Kalman et al. | |
| 2008/0006407 | A1* | 1/2008 | Lehr | E21B 33/134 166/298 |
| 2008/0078548 | A1 | 4/2008 | Pauls et al. | |
| 2008/0196896 | A1 | 8/2008 | Bustos et al. | |
| 2008/0196897 | A1 | 8/2008 | Nguyen | |
| 2009/0032255 | A1 | 2/2009 | Surjaatmadja et al. | |
| 2011/0100625 | A1* | 5/2011 | Popov | C09K 8/516 166/293 |
| 2011/0162846 | A1 | 7/2011 | Palidwar et al. | |
| 2011/0209873 | A1 | 9/2011 | Stout | |
| 2014/0096950 | A1 | 4/2014 | Pyecroft et al. | |
| 2014/0096970 | A1 | 4/2014 | Andrew et al. | |
| 2014/0131035 | A1 | 5/2014 | Entchev et al. | |
| 2014/0318782 | A1 | 10/2014 | Bourque | |
| 2015/0060063 | A1 | 3/2015 | Miller | |
| 2015/0083419 | A1 | 3/2015 | Getzlaf et al. | |
| 2015/0122493 | A1 | 5/2015 | Wood et al. | |
| 2015/0233217 | A1* | 8/2015 | Kratochvil | E21B 33/124 166/297 |

OTHER PUBLICATIONS

International Search Report with Written Opinion dated Jan. 8, 2016 for International Patent Application No. PCT/US15/060280, 16 pages.
Australian Examination Report dated Aug. 9, 2016 for AU Patent Application No. 2015350289, 4 pages.
Office Action dated Jul. 16, 2015 for U.S. Appl. No. 14/720,532, 28 pages.
Office Action dated Nov. 13, 2015 for U.S. Appl. No. 14/720,532, 14 pages.
Office Action dated Nov. 3, 2016 for U.S. Appl. No. 14/720,532, 14 pages.
Office Action dated Jun. 30, 2016 for U.S. Appl. No. 14/720,532, 14 pages.
Office Action dated Aug. 25, 2016 for U.S. Appl. No. 14/720,532, 16 pages.
Office Action dated Feb. 23, 2017 for U.S. Appl. No. 14/720,532, 13 pages.
Chinese Second Office Action dated Apr. 8, 2018 for CN Patent Application No. 2015800047180, 7 pages.
English Translation of Chinese Second Office Action dated Apr. 8, 2018 for CN Patent Application No. 2015800047180, 12 pages.
Columbia Office Action dated Mar. 12, 2019 for CO patent application No. 16-173.525, 10 pages.
English Translation of Columbia Office Action dated Mar. 12, 2019 for CO patent application No. 16-173.525, 10 pages.
Examiner's Report dated Jan. 31, 2021 for SA Patent Application No. 516371568, 6 pages.
English Translation of Examiner's Report dated Jan. 31, 2021 for SA Patent Application No. 516371568, 4 pages.

* cited by examiner

WELL COMPLETION

CROSS-REFERENCE TO RELATED APPLICATION

This application is a division of prior U.S. application Ser. No. 14/720,532 filed on 22 May 2015, which claims the benefit of the filing dates of US provisional application nos. 62/082299 filed on 20 Nov. 2014 and 62/103,786 filed on 15 Jan. 2015. The entire disclosures of these prior applications are incorporated herein by this reference.

BACKGROUND

This disclosure relates generally to equipment utilized and operations performed in conjunction with a subterranean well and, in an example described below, more particularly provides a well completion system and method.

It can be highly desirable to decrease expenses, reduce time, simplify operations and increase reliability in well completions. Therefore, it will be readily appreciated that improvements are continually needed in the art of well completions.

DETAILED DESCRIPTION

Figure 1:
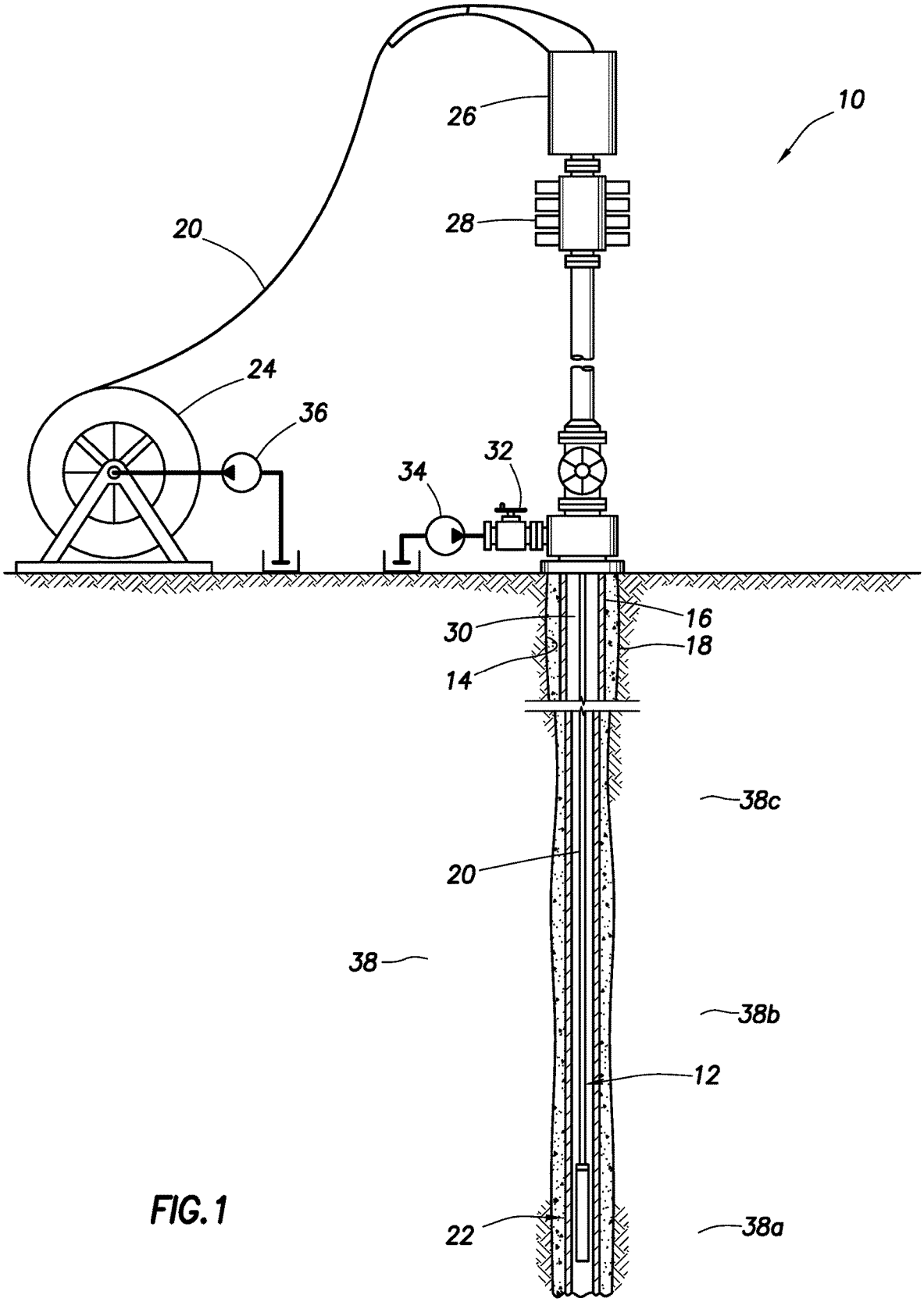
FIG. 1 is a representative partially cross-sectional view of one example of a well completion system and associated method which can embody principles of this disclosure.

Representatively illustrated in FIG. 1 is a well completion system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 is conveyed into a wellbore 14 lined with casing 16 and cement 18. Although multiple casing strings would typically be used in actual practice, for clarity of illustration only one string of casing 16 is depicted in the drawings.

As used herein, the term "casing" is used to refer to a protective wellbore lining. Casing could be of the types known to those skilled in the art as casing, tubing or liner. Casing may be segmented or continuous. Casing may be pre-formed or formed in situ. Casing may be made of steel, other metals or alloys, polymers, composites, or any other material. The scope of this disclosure is not limited to use of any particular type of casing, or to use of casing at all.

As used herein, the term "cement" is used to refer to a material which hardens to secure and seal a casing in a wellbore. Cement does not necessarily comprise a cementitious material, since hardenable polymers (such as epoxies) or other materials may be used instead. Cement may harden due to hydration, passage of time, exposure to heat, exposure to a hardening agent, or due to any other stimulus. The scope of this disclosure is not limited to use of any particular type of cement, or to use of cement at all.

Although the wellbore 14 is illustrated as being vertical, sections of the wellbore could instead be horizontal or otherwise inclined relative to vertical. Although the wellbore 14 is completely cased and cemented as depicted in FIG. 1, any sections of the wellbore in which operations described in more detail below are performed could be uncased or open hole. Thus, the scope of this disclosure is not limited to any particular details of the system 10 and method.

The tubular string 12 of FIG. 1 comprises coiled tubing 20 and a perforating assembly 22. As used herein, the term "coiled tubing" refers to a substantially continuous tubing that is stored on a spool or reel 24. The reel 24 could be mounted, for example, on a skid, a trailer, a floating vessel, a vehicle, etc., for transport to a wellsite. Although not shown in FIG. 1, a control room or cab would typically be provided with instrumentation, computers, controllers, recorders, etc., for controlling equipment such as an injector 26 and a blowout preventer stack 28.

It is not necessary for the tubular string 12 to include coiled tubing. In some examples, the tubular string 12 could comprise jointed pipe.

When the tubular string 12 is positioned in the wellbore 14, an annulus 30 is formed radially between them. Fluid, slurries, etc., can be flowed from surface into the annulus 30 via, for example, a casing valve 32. One or more pumps 34 may be used for this purpose. Fluid can also be flowed to surface from the wellbore 14 via the annulus 30 and valve 32.

Fluid, slurries, etc., can also be flowed from surface into the wellbore 14 via the tubing 20, for example, using one or more pumps 36. Fluid can also be flowed to surface from the wellbore 14 via the tubing 20.

In the FIG. 1 system 10 and method, the perforating assembly 22 is used to perforate each of multiple zones 38*a-c* of a formation 38 penetrated by the wellbore 14. The zones 38*a-c* may be sections or intervals of a same earth formation, or they may be sections or intervals of multiple formations. Any number of zones may be perforated.

In this example, the zones 38*a-c* are perforated in succession from the lowermost (farthest from surface along the wellbore 14) zone 38*a* to the uppermost (closest to surface along the wellbore) zone 38*c*. However, in other examples the zones 38*a-c* may not be perforated in succession, or they may not be perforated from the lowermost to the uppermost zone. Multiple zones could be perforated simultaneously. Thus, the scope of this disclosure is not limited to any particular number, order, combination, configuration or arrangement of zones being perforated.

Figure 2:
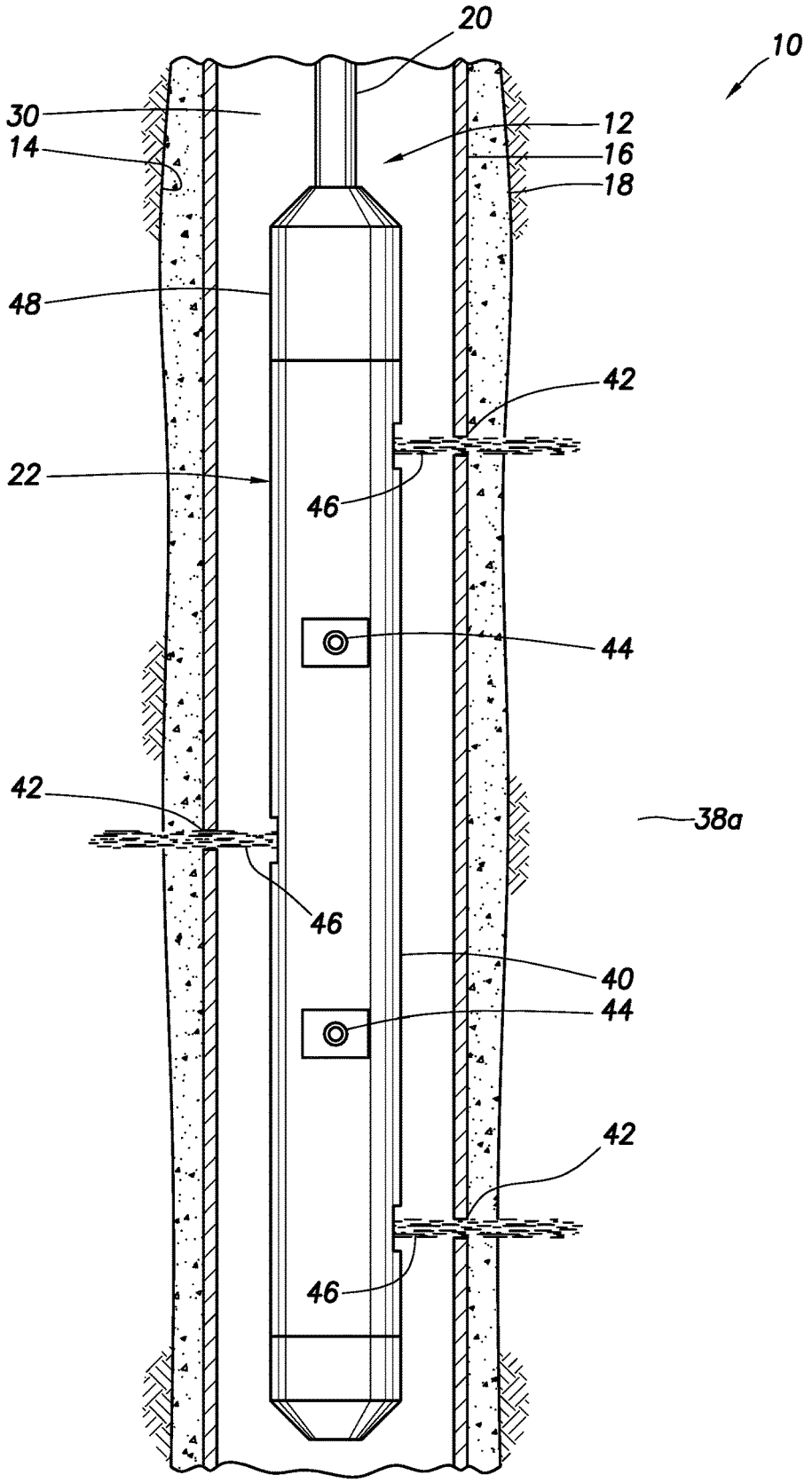
FIG. 2 is a representative enlarged scale partially cross-sectional view of an abrasive jet perforator perforating a zone in the system and method of FIG. 1.

Referring additionally now to FIG. 2, an enlarged scale view of the perforating assembly 22 is representatively illustrated in the system 10, with the perforating assembly being positioned in the wellbore 14 at the zone 38*a*. However, the perforating assembly 22 may be used in other systems and methods, in keeping with the principles of this disclosure.

In this view it may be seen that the perforating assembly 22 includes at least one perforator 40 and a tubing connector 48 for connecting the perforator to the tubing 20. The perforator 40 is used to form perforations 42 through the casing 16 and cement 18, in order to provide for fluid communication between the wellbore 14 and the zone 38*a*.

In this example, the perforator 40 is an abrasive jet perforator with erosion resistant nozzles 44 to direct an abrasive slurry 46 toward the casing 16, so that the perforations 42 will be formed through the casing and cement 18, and into the zone 38*a*. For example, the slurry 46 could be a composition including water and abrasive particles (such as, sand, ceramics, calcium carbonate or another soluble substance, etc.).

Note that any number of perforations 42 may be formed in each of the zones 38*a-c*. Flow rate, pressure, nozzle diameter, number of nozzles 44, abrasive slurry 46 composition, flow duration and other factors will determine a size (e.g., diameter and length) of the perforations 42 formed by the perforator 40.

In other examples, other types of perforators may be used. For example, an explosive shaped charge perforating gun may be used to form the perforations 42. Thus, the scope of this disclosure is not limited to use of any particular type of perforator.

Figure 3:
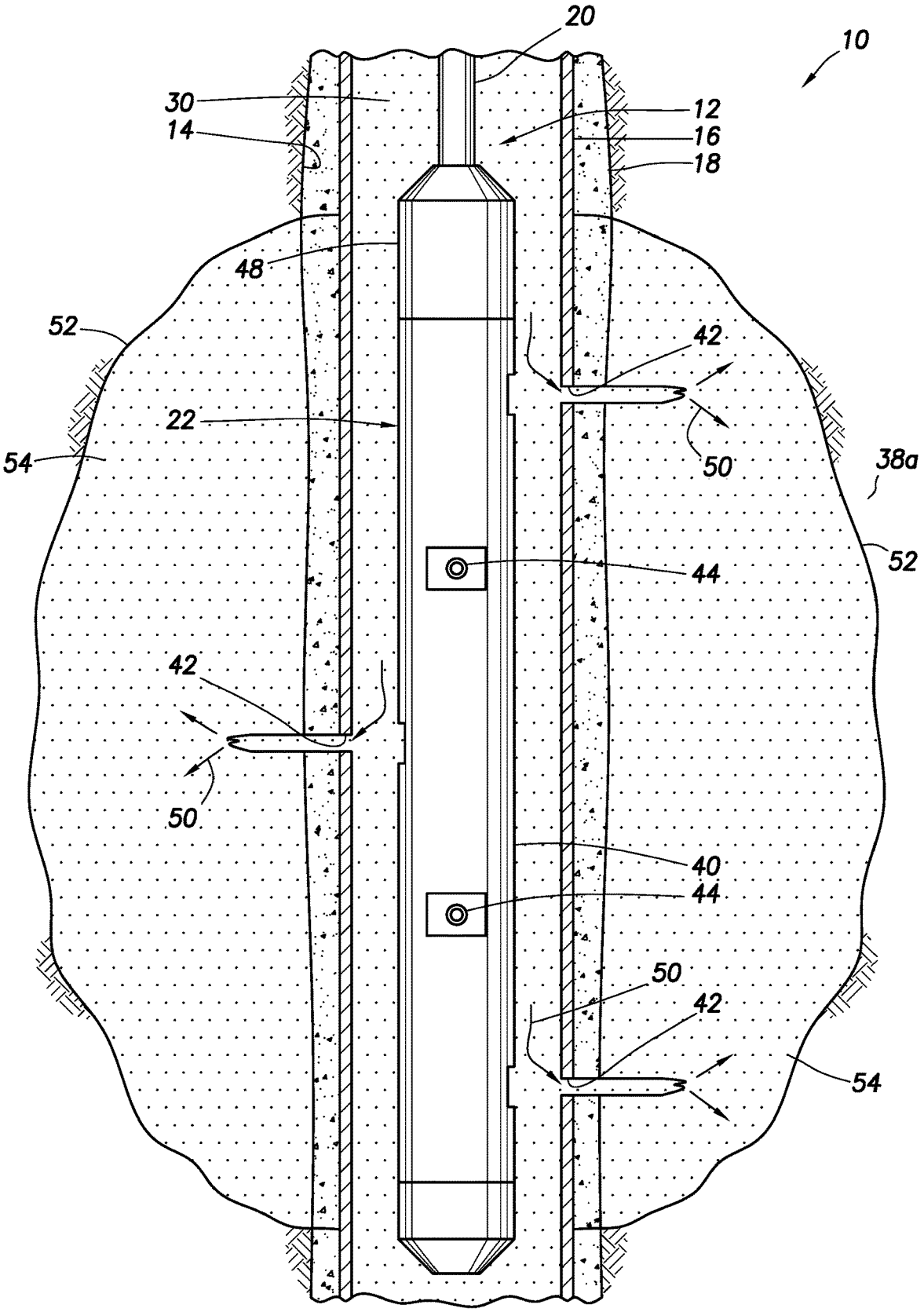
FIG. 3 is a representative partially cross-sectional view of the zone being fractured.

Referring additionally now to FIG. 3, the zone 38*a* is being fractured by flowing a fracturing fluid 50 under pressure into the zone via the perforations 42. The fracturing fluid 50 may be in the form of a slurry, with proppant 54 mixed therein to prop open fractures 52 formed in the zone. The proppant 54 may be sand, ceramic or glass beads, polymer beads or other materials or shapes, etc.

In the FIG. 3 example, the fracturing fluid 50 is flowed to the perforations 42 via the annulus 30. Referring again to FIG. 1, the pumps 34 can be used to pump the fracturing fluid 50 under pressure and at a relatively high flow rate into the annulus 30, so that the fracturing fluid enters the zone 38*a* via the perforations 42 and a fracture pressure in the zone is exceeded, thereby causing the fractures 52 to be formed in the zone.

In this example, during the fracturing operation, fluid flow into the perforator 40 is prevented, in order to prevent the nozzles 44 from being plugged or damaged by the proppant 54, and to allow sufficient pressure to build up and cause fracturing of the zone 38*a*. For example, a valve at surface could be closed to prevent fluid flow out of the tubing 20, or a circulation control valve (see FIGS. 9 & 10) could be provided in the perforating assembly 22 to control flow through the tubular string 12.

In other examples, the fracturing fluid 50 could be delivered to the perforations 42 via the tubular string 12, in which case the casing valve 32 could be closed to allow sufficient pressure to build up and cause fracturing of the zone 38*a*. In such examples, the nozzles 44 could be configured to allow the proppant 54 to flow therethrough without plugging the nozzles, or a circulation control valve (see FIGS. 9 & 10) or other flow control device could be used to discharge the fracturing fluid 50 into the wellbore 14.

Additional stimulation and/or conformance treatments (such as, acidizing, permeability and/or wettability modification, etc.) could be performed prior to, simultaneously with, or after, the fracturing operation. Such treatments could alternatively be performed after all of the zones 38*a-c* have been perforated and fractured.

Figure 4:
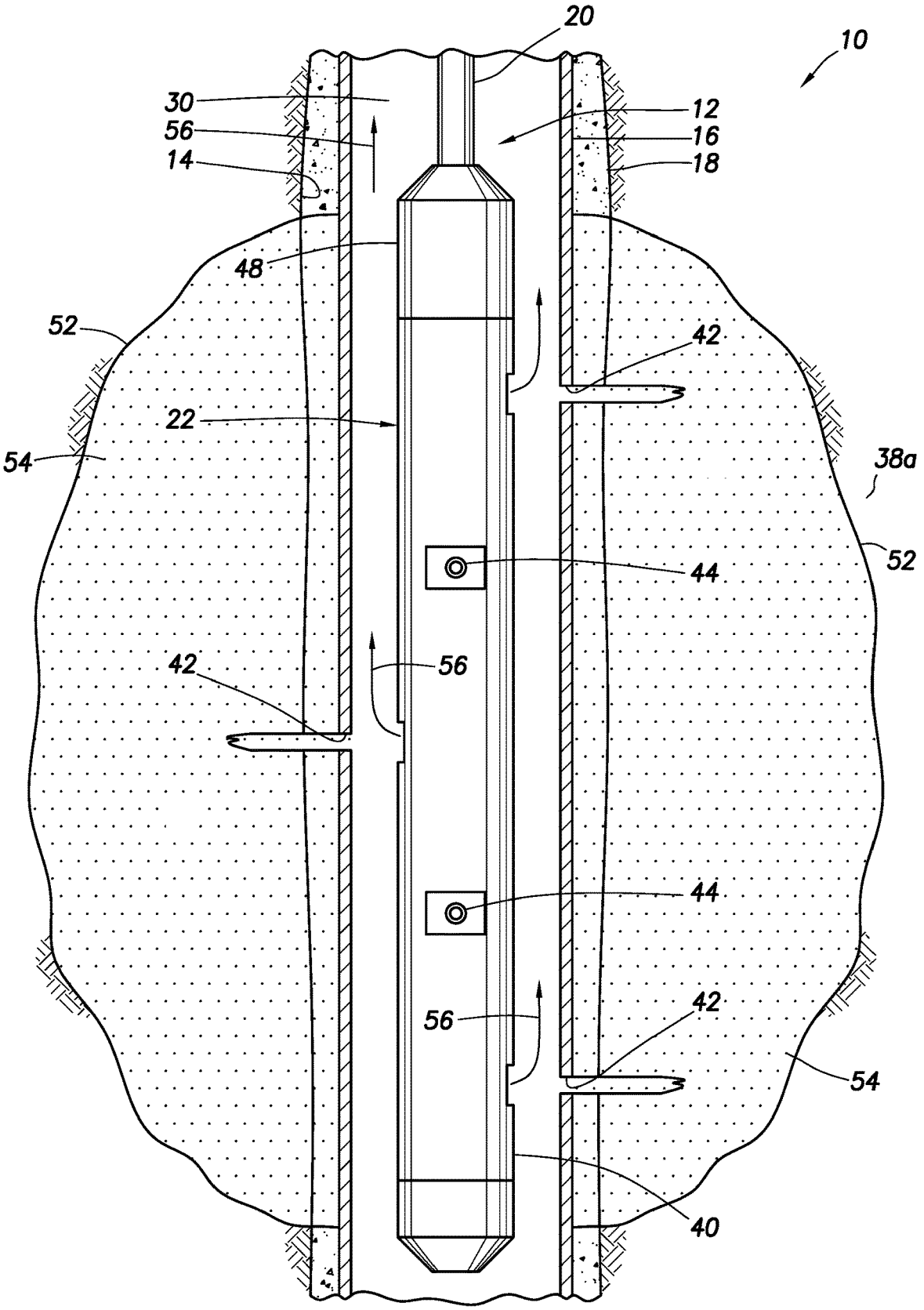
FIG. 4 is a representative partially cross-sectional view of a flushing technique.

Referring additionally now to FIG. 4, the system 10 and method are representatively illustrated with a flushing fluid 56 (such as, water, a combination of fluids, etc.) being used to flush the proppant 54 out of the wellbore 14 after the fracturing operation. The proppant 54 is carried with the flushing fluid 56 via the annulus 30 to surface.

Note that it is not necessary for the proppant 54 to be flushed out of the wellbore 14 immediately after the fracturing operation. In some examples, the flushing operation could be delayed until after all of the zones 38*a-c* have been perforated and fractured.

Figure 5:
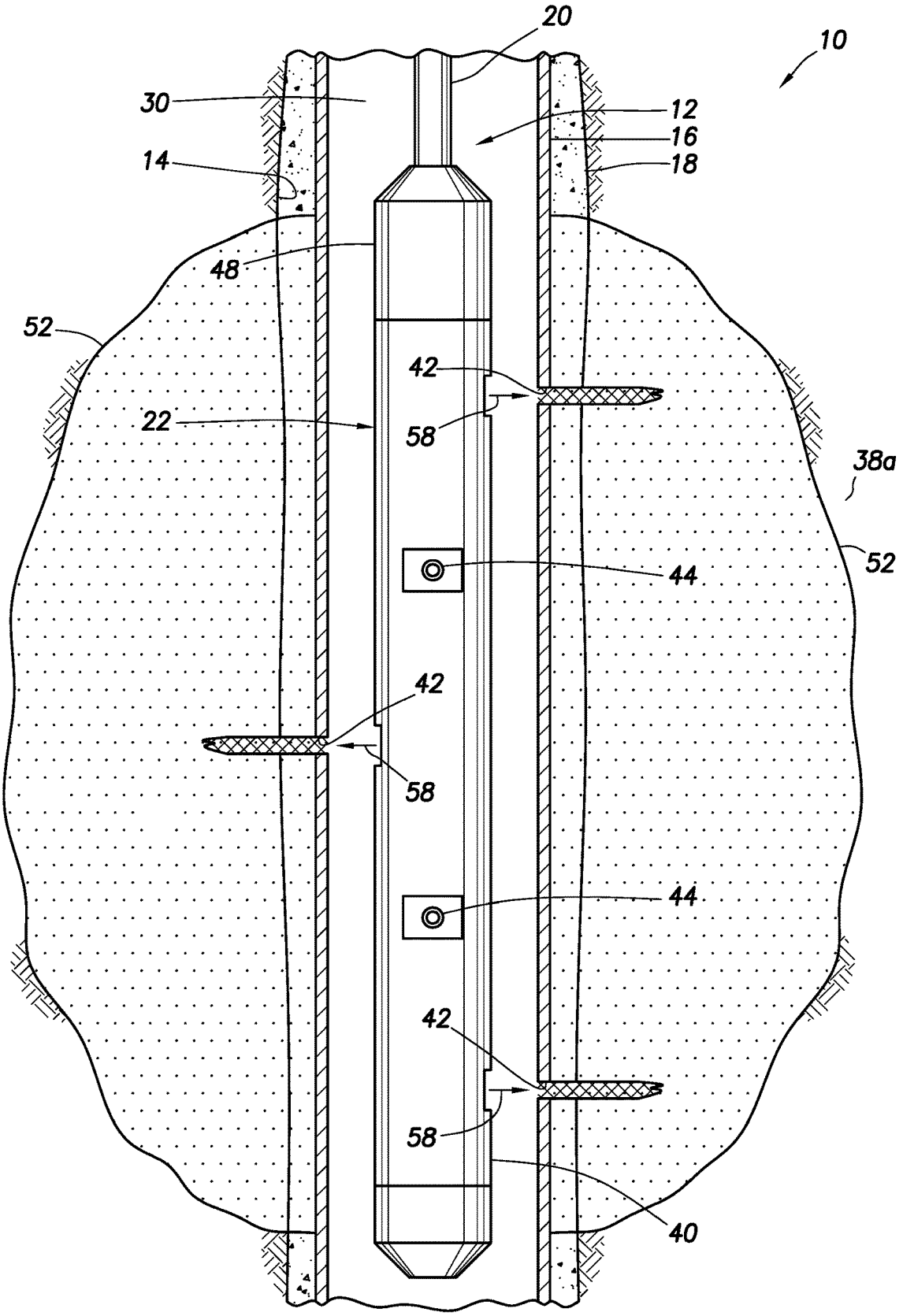
FIG. 5 is a representative partially cross-sectional view of a plug substance being flowed into perforations.

Referring additionally now to FIG. 5, the system 10 and method are representatively illustrated with a plug substance 58 being delivered to the perforations 42 via the tubular string 12. In this example, the plug substance 58 is flowed through the tubing 20 to the perforator 40, and out of the nozzles 44.

In other examples, the plug substance 58 could be delivered to the perforations 42 using other techniques. For example, the plug substance 58 could be flowed from surface via the annulus 30. As another example, the plug substance 58 could be flowed through the tubing 20 and discharged into the annulus 30 via a valve (see FIG. 9). Thus, the scope of this disclosure is not limited to any particular technique for delivering the plug substance 58 to the perforations 42.

The plug substance 58 is preferably flowable and capable of preventing fluid communication from the wellbore 14 to the zone 38*a*. In this manner, additional zones can be fractured by application of pressure to the wellbore 14, without substantial fluid loss from the wellbore to the zone 38*a*. "Substantial fluid loss" would be fluid loss sufficient to prevent pressure buildup in the wellbore 14 for fracturing one or more additional zones.

Depending on a composition of the plug substance 58, the plug substance 58 may be capable of substantially preventing fluid communication from the wellbore 14 to the zone 38*a*, when the plug substance is in the wellbore and perforations 42 as depicted in FIG. 5. In some examples, however, it may be desired or necessary to flow the plug substance 58 into the fractures 52, in order to ensure that fluid flow from the wellbore 14 to the zone 38*a* is substantially prevented in subsequent fracturing operations.

Figure 6:
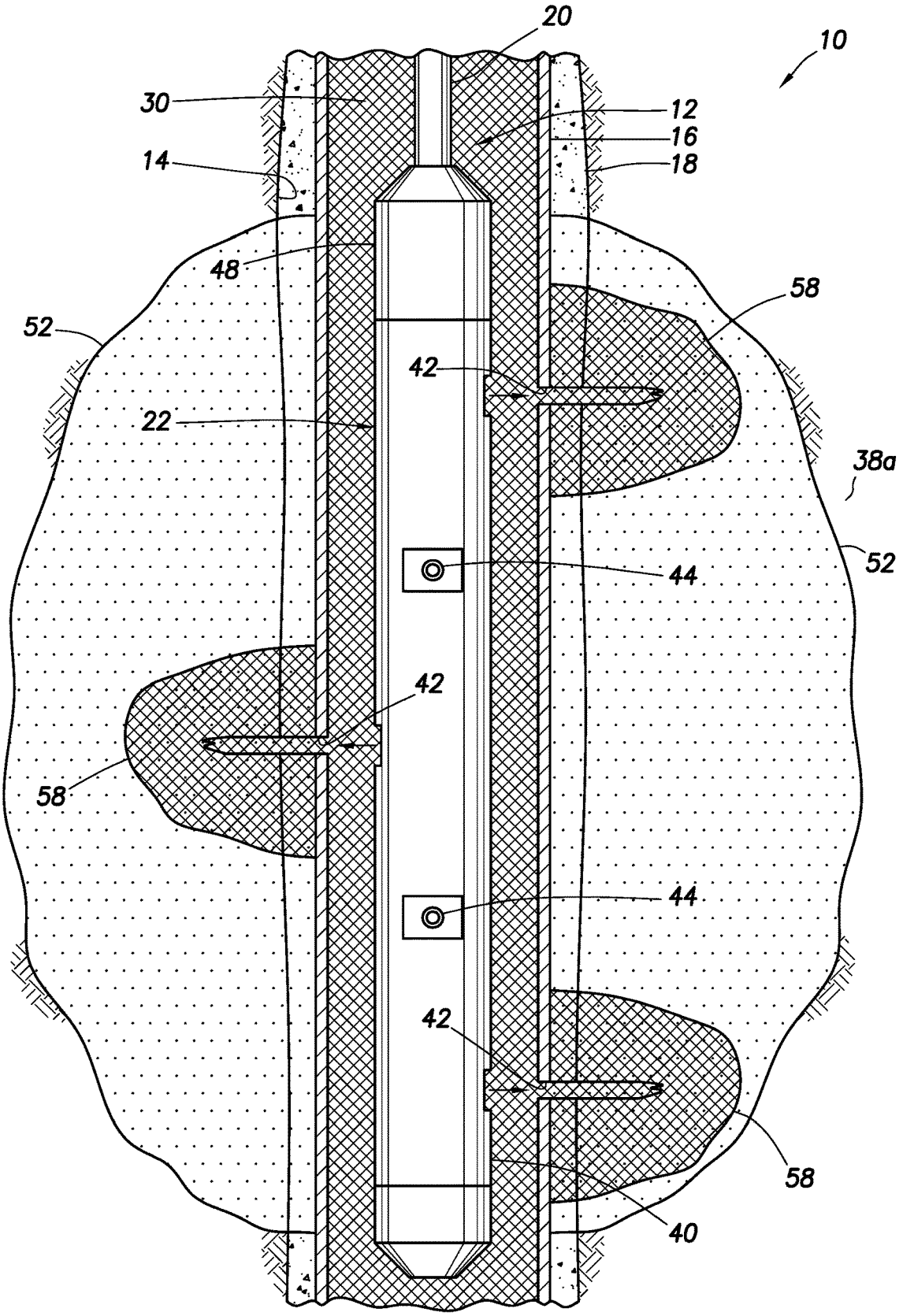
FIG. 6 is a representative partially cross-sectional view of the plug substance being pressurized and flowed into fractures in the zone.

Referring additionally now to FIG. 6, the system 10 and method are representatively illustrated with the plug substance 58 being pressurized and forced to flow at least partially into the fractures 52. Note that the plug substance 58 also fills the wellbore 14 at the zone 38*a*.

Such placement of the plug substance 58 in the wellbore 14, perforations 42 and fractures 52 enables additional zones to subsequently be fractured, without substantial fluid loss to the zone 38*a*.

The plug substance 58 can comprise any of a variety of different substances, or combinations thereof. For example, gels, resins, plastics, polymers, calcium carbonate, sand with appropriate grain size, nylon (an aliphatic polyamide) fibers, poly-lactic acid (PLA, a thermoplastic aliphatic polyester), poly-glycolic acid (PGA, a thermoplastic aliphatic polyester), etc., may be used for the plug substance 58.

After all zones 38*a-c* have been perforated and fractured, fluid communication from the zones 38*a-c* can be allowed by dispersing, dissolving, removing, breaking, liquefying, degrading or otherwise causing the plug substance 58 to no longer prevent or restrict fluid flow. For example, if the plug substance 58 comprises calcium carbonate or nylon fibers, a suitable acid (such as, hydrochloric acid) may be flowed into contact with the plug substance to dissolve it. If the plug substance 58 comprises a gel, a suitable breaker may be flowed into contact with the gel (or may be initially combined with the gel), so that the gel is broken or liquefied and can be readily flowed out of the well. If the breaker is initially combined with the gel, the gel can be broken or liquefied after a predetermined time period, due to exposure to an elevated temperature for a predetermined time period, etc.

If the plug substance 58 comprises a resin or polymer, a suitable solvent or other chemical composition may be used to dissolve or otherwise degrade the plug substance. If the plug substance 58 comprises a particulate material, such as sand, the plug substance may be removed by flushing it from the wellbore 14 and perforations 42. Thus, the scope of this disclosure is not limited to use of any particular type of plug substance, or to any particular technique for dispersing, dissolving, removing, breaking, liquefying, degrading or otherwise causing the plug substance to no longer prevent or restrict fluid flow.

Figure 7:
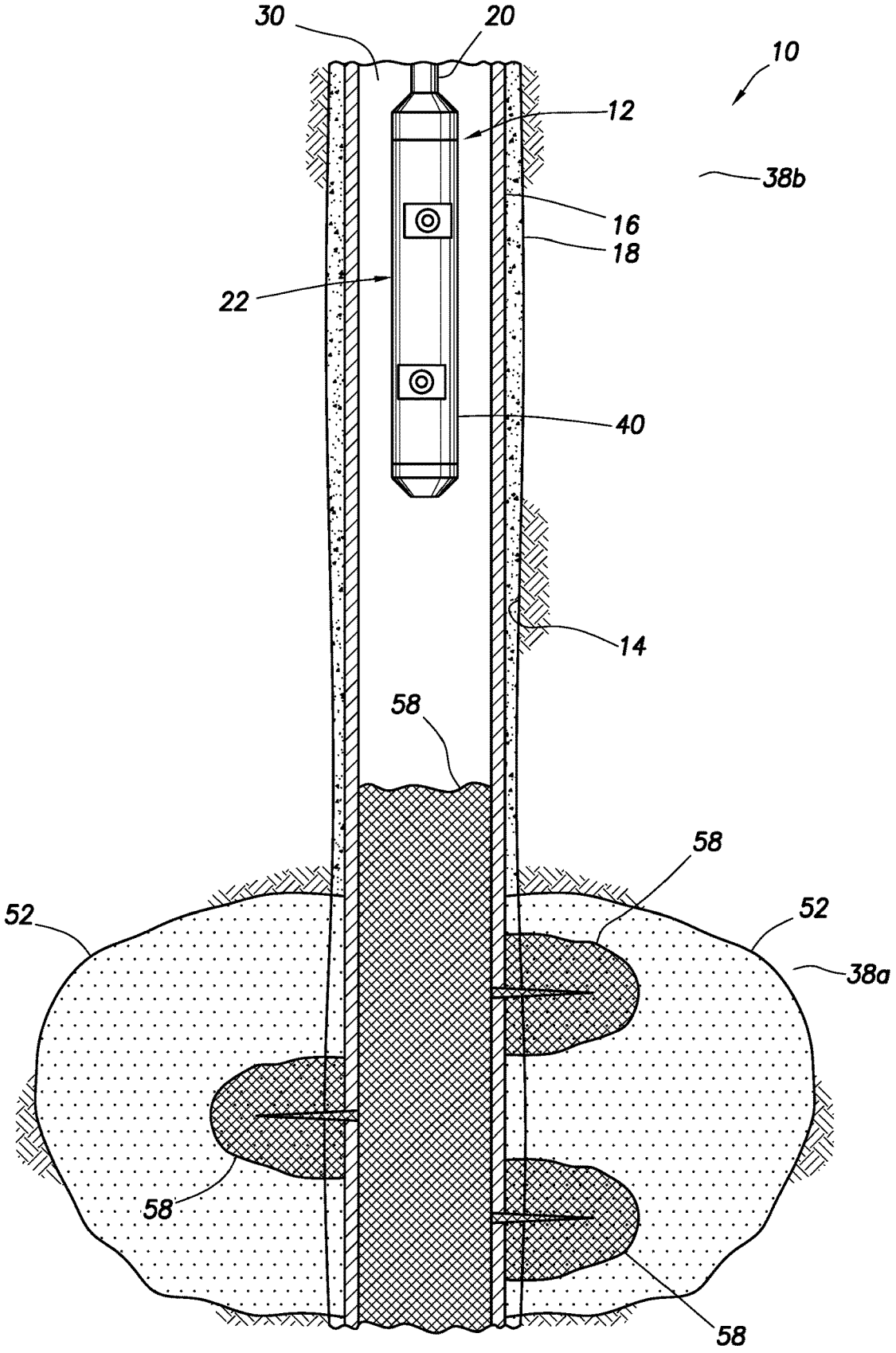
FIG. 7 is a representative reduced scale partially cross-sectional view of the abrasive jet perforator being repositioned to another zone.

Referring additionally now to FIG. 7, the system 10 and method are representatively illustrated with the perforating assembly 22 repositioned in the wellbore 14, so that it is at the next zone 38*b* to be perforated and fractured. Note that the plug substance 58 now substantially isolates the lowermost zone 38*a* from fluid communication with the wellbore 14, so that fracturing operations can be performed for other zones 38*b,c* without substantial fluid loss to the zone 38*a* or further fracturing of the zone 38*a*.

The zone 38*b* can now be perforated and fractured as described above and depicted in FIGS. 2-6 for the zone 38*a*. Furthermore, this process can be repeated as many times as needed for a corresponding number of zones, except that it is not necessary for the plug substance 58 to be used after a last zone is fractured (there is no need to isolate the last zone from any subsequent fracturing pressure).

Figure 8:
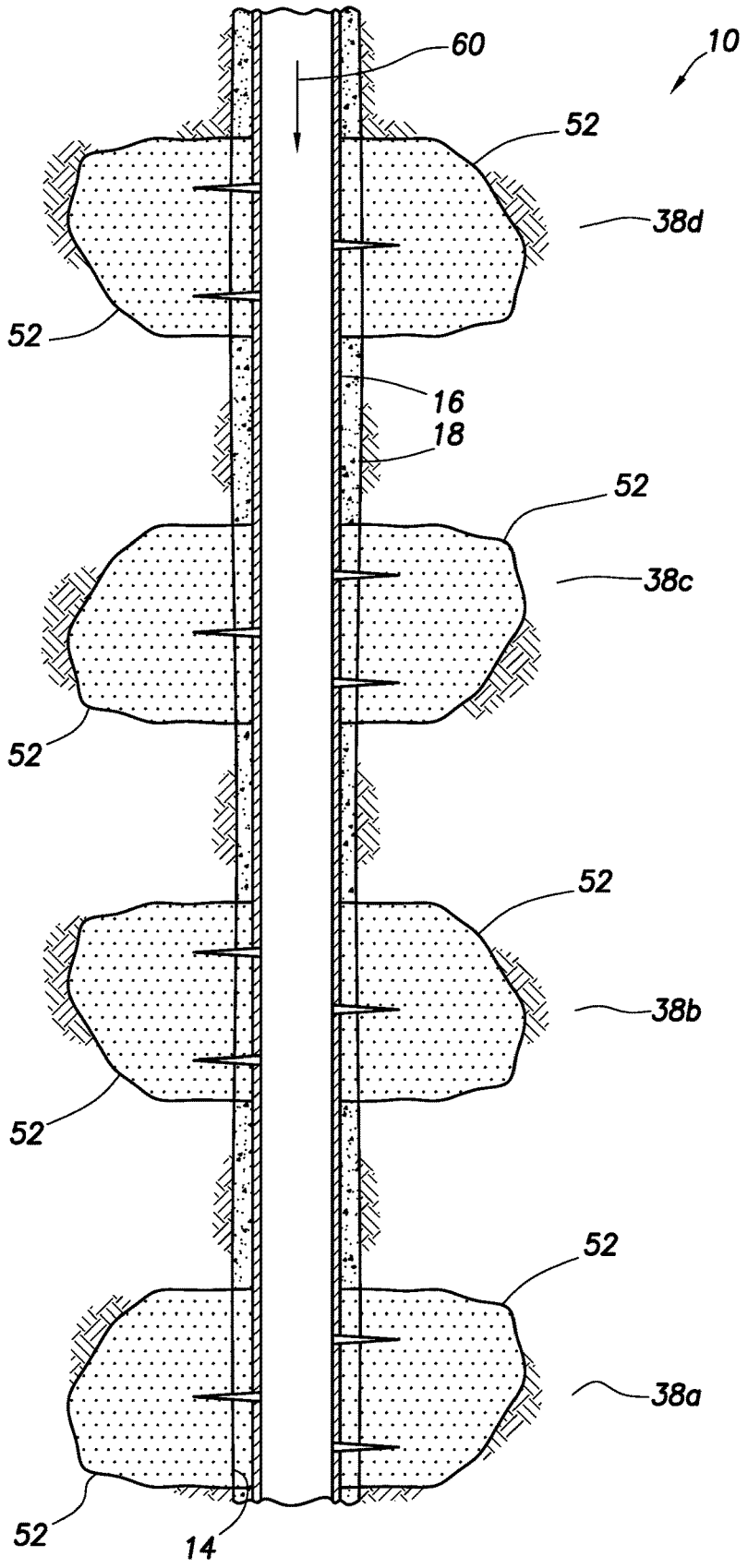
FIG. 8 is a representative further reduced scale cross-sectional view of the system, in which multiple zones have been fractured.

Referring additionally now to FIG. 8, the system 10 and method are representatively illustrated after four zones 38*a-d* have been perforated and fractured. Of course, any number of zones may be perforated and fractured, in keeping with the principles of this disclosure.

An acid or another solvent, a breaker, a flushing fluid, or another substance 60 can be used to disperse, dissolve, remove, break, liquefy or degrade the plug substance 58. In this manner, the plug substance 58 will not prevent or substantially restrict flow of fluid from the zones 38*a-d* to the wellbore 14 for production to the surface.

In the FIG. 8 example, the unplugging substance 60 is depicted as being flowed into the wellbore 14 after retrieval of the tubular string 12. However, in other examples the unplugging substance 60 may be delivered to the wellbore 14 via the tubular string 12 or via the annulus 30. For example, the substance 60 could be flowed into the wellbore 14 via the nozzles 44 of the perforator 40 or via a valve (see FIG. 9).

Figure 9:
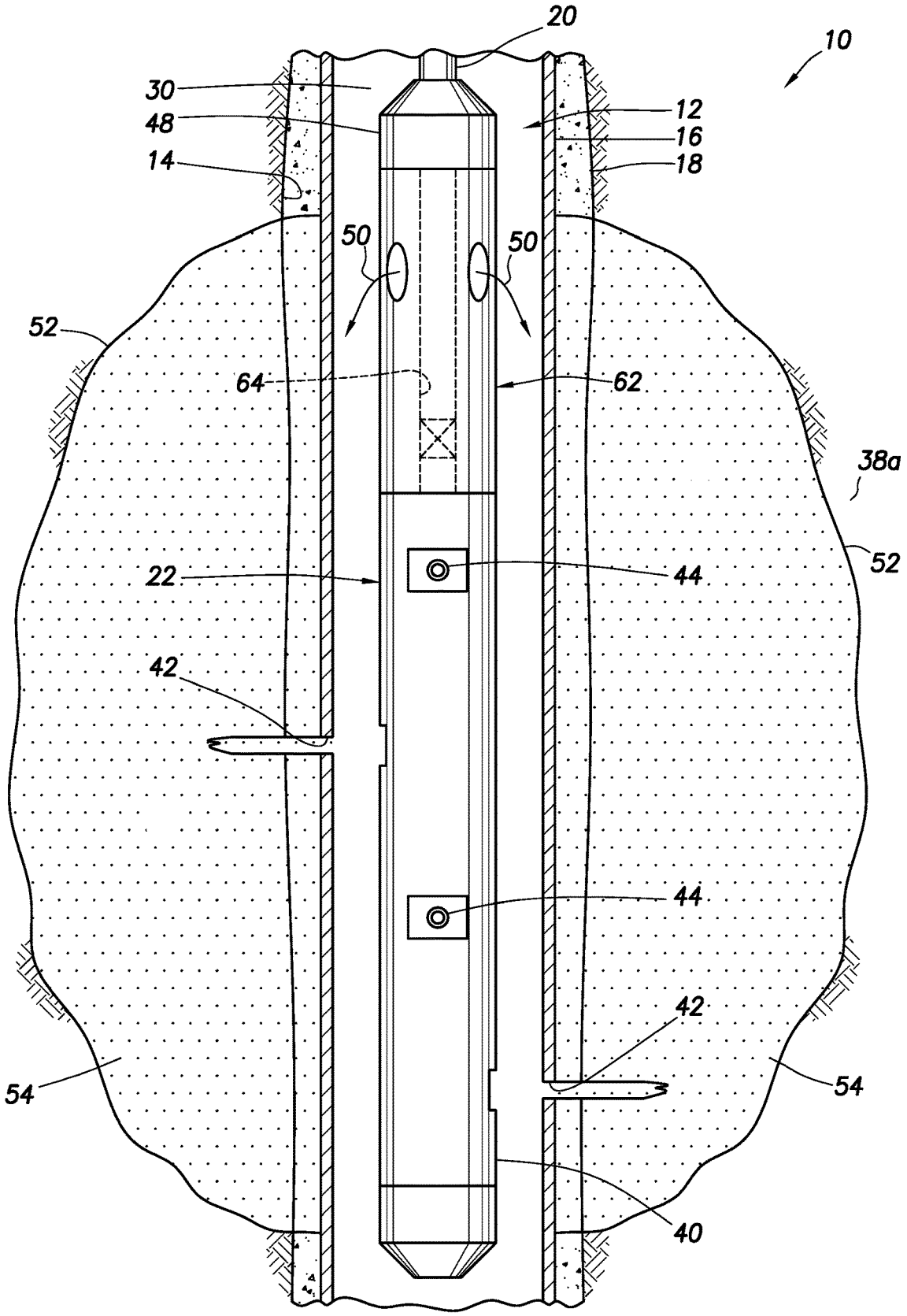
FIG. 9 is a representative enlarged scale partially cross-sectional view of another example of the system and method, in which a valve is used to deliver a fracturing fluid and/or the plug substance to the zone.

Referring additionally now to FIG. 9, another example of the tubular string 12 is representatively illustrated. In this example, the tubular string 12 includes a valve assembly 62 connected between the perforator 40 and the connector 48. However, the valve assembly 62 could be otherwise positioned in keeping with the principles of this disclosure.

Circulation control valves are well known to those skilled in the art, and so will only briefly be described here. Suitable circulation control valves include those described in U.S. Pat. Nos. 8,403,049 and 8,490,702, in International application serial no. PCT/US14/62651 filed 28 Oct. 2014 and in International application serial no. PCT/US15/29399 filed 6 May 2015, the entire disclosures of which are incorporated herein by this reference. The scope of this disclosure is not limited to use of any particular circulation control valve.

In the FIG. 9 example, the valve assembly 62 is capable of selectively permitting and preventing fluid communication through an internal longitudinal flow passage 64, and is capable of selectively permitting and preventing fluid communication between the flow passage and the annulus 30 external to the valve assembly. As depicted in FIG. 9, the valve assembly 62 is preventing flow through the passage 64, but is permitting flow from the passage to the annulus 30, so that fracturing fluid 50 can be delivered to the perforations 42 during fracturing of the zone 38*a*.

A similar configuration of the valve assembly 62 may be used when flushing the proppant 54 out of the wellbore 14 after the fracturing operation, or when delivering the plug substance 58 to the perforations 42 after the flushing operation. The valve assembly 62 may be configured to permit flow longitudinally through the passage 64, but to prevent flow from the passage to the annulus 30 during the perforating operation (thereby allowing the abrasive slurry 46 to flow to the nozzles 44).

The valve assembly 62 may be configured to prevent flow longitudinally through the passage 64, and to prevent flow between the passage and the annulus 30, for example, when pressure is applied to the zone 38*a* via the annulus (such as, when the fracturing fluid 50 is delivered to the perforations 42 via the annulus, or when the plug substance 58 is forced into the perforations and fractures 52). However, it should be clearly understood that the scope of this disclosure is not limited to use of the valve assembly 62, or to use of any particular configuration of the valve assembly during any particular operation.

Figure 10:
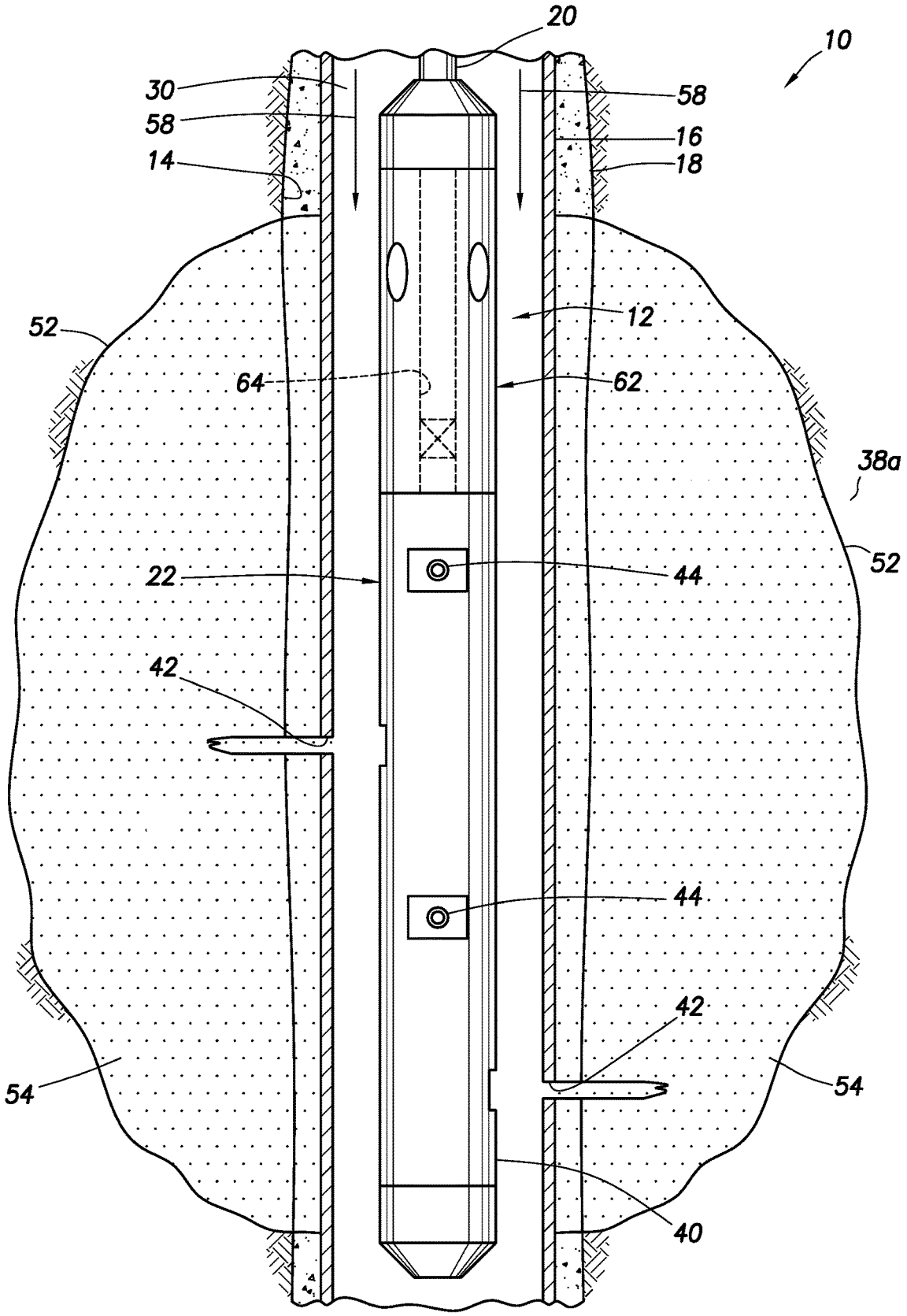
FIG. 10 is a representative partially cross-sectional view of another example of the system and method, in which the plug substance is delivered to the zone via a well annulus.

Referring additionally now to FIG. 10, another example of the system 10 and method is representatively illustrated, in which the plug substance 58 is flowed to the perforations 42 from the surface via the annulus 30. In this example, the valve assembly 62 may be configured so that it prevents flow longitudinally through the passage 64 and thereby substantially prevents the plug substance 58 from flowing into the nozzles 44.

The valve assembly 62 in this configuration may permit circulation from the annulus 30 to the passage 64 and via the tubing 20 to the surface. Such circulation flow may be restricted or prevented at surface once an appropriate volume of the plug substance 58 has been delivered into the wellbore 14, so that the wellbore can then be pressurized to force the plug substance into the perforations 42 and fractures 52, if desired.

Continuous, or substantially continuous, flowing of fluids, slurries, etc., via the tubing string 12 and annulus 30 can be utilized to minimize unproductive time in the well completion system 10 and method. For example, the fracturing fluid 50 and the flushing fluid 56 can be delivered to the wellbore 14 in stages, via the tubular string 12 and/or annulus 30, without any shutting down of the pump(s) used to deliver these fluids. Similarly, the plug substance 58 can be followed by the abrasive slurry 46 through the tubing 20 when the perforating assembly 22 is repositioned after one zone is fractured and another zone is about to be perforated.

Furthermore, it is not necessary for the tubular string 12 to remain motionless in the wellbore 14 while fluids, slurries, etc., are flowed through the tubular string and/or wellbore. For example, after one zone has been perforated, fractured and plugged off, the perforating assembly 22 can be repositioned to another zone while the plug substance 58 continues to be flowed into the wellbore 14, and while the abrasive slurry 46 is being introduced into the tubing 20 so that, when the perforator 40 is in position for perforating the next zone, the abrasive slurry reaches the perforator and begins perforating the next zone. A spacer fluid could be introduced between the plug substance 58 and the abrasive slurry 46, if it is not desired for the plug substance to extend in the wellbore 14 all the way between the zones. As another example, if the valve assembly 62 is used to deliver the flushing fluid 56 or the unplugging substance 60 into the wellbore 14, the tubular string 12 may be displaced while the flushing and/or unplugging operations are being performed.

Figure 11:
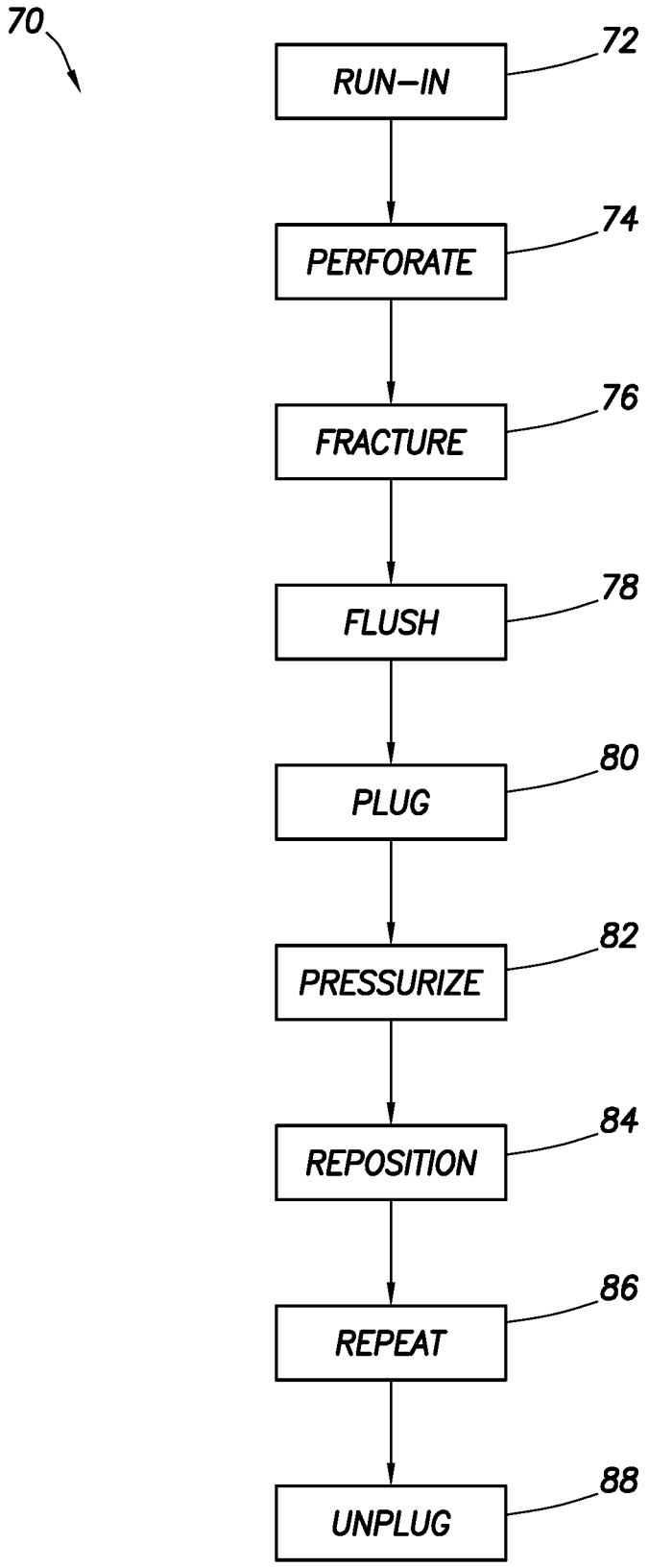
FIG. 11 is a representative flowchart for one example of the method.

Referring additionally now to FIG. 11, a flowchart for one example of a well completion method 70 is representatively illustrated. The method 70 may be used with the well completion system 10 examples described above, or it may be used with other systems. For convenience, the system 10 is used below in the further description of the method 70.

In step 72 of the method 70, the perforating assembly 22 is run into the wellbore 14 using the tubing 20, and the perforator 40 is positioned at the first of multiple zones 38*a-d* to be perforated. The first zone to be perforated may be a lowermost zone 38*a*, an uppermost zone 38*d*, or any other zone. For convenience, the lowermost zone 38*a* is used as the first zone in the further description of the method 70.

Note that it is not necessary for the tubing 20 to be used to convey the perforating assembly 22 through the wellbore 14. Other types of conveyances (such as, segmented tubing, wireline, slickline, a tractor, etc.) may be used in other examples.

In step 74, the zone 38*a* is perforated. In the system 10 described above, the abrasive slurry 46 is used to form the perforations 42 through the casing 16 and cement 18. In other examples, an abrasive slurry may not be used (e.g., shaped charges, mechanical cutters, or other types of perforating devices could be used), and/or the perforations may not be formed through casing and/or cement (e.g., the wellbore 14 may be uncased and/or uncemented).

In step 76, the zone 38*a* is fractured. The zone 38*a* may be fractured by forcing the fracturing fluid 50 (including any proppant 54) under pressure into the zone 38*a*. The fracturing fluid 50 may be delivered to the zone 38*a* via the annulus 30 and/or via the tubing 20. If the fracturing fluid 50 is flowed through the tubing 20, it may exit via the nozzles 44 of the perforator 40, or via the valve assembly 62.

Additional treatment fluids, substances, diverters, acids, gels, conformance agents, surfactants, etc., may be flowed into the zone 38*a* before, during or after the fracturing operation. The scope of this disclosure is not limited to any particular number, type or combination of fluids or other substances flowed into the zone 38*a*.

In step 78, the wellbore 14 is flushed. The flushing may be to remove excess proppant 54 and/or other substances (such as, acids, gels, diverters, etc.) from the wellbore 14 prior to the plugging operation of step 80. However, since the wellbore 14, or at least the zone 38*a* is to be plugged, this flushing operation may be deferred until after all of the zones 38*a-d* have been fractured.

In step 80, the zone 38*a* is plugged, so that fluid flow from the wellbore 14 into the zone is prevented, or at least substantially mitigated. Such plugging will allow a subsequent zone to be fractured, without substantial loss of fluid to the zone 38*a*. A significant pressure increase should be noted (e.g., at surface, or using downhole pressure sensors) when the plug substance 58 successfully plugs off the zone 38*a*.

In the system 10, the plug substance 58 may be delivered to the zone 38*a* via the tubular string 12 and/or via the annulus 30. If the plug substance 58 is flowed through the tubing 20, it may exit via the nozzles 44 of the perforator 40, or via the valve assembly 62.

In this step 80, the plug substance 58 is delivered to the perforations 42 and can fill a longitudinal section of the wellbore 14. This placement of the plug substance 58 can, in some cases, successfully plug off the zone 38*a*.

In step 82, pressure is applied to force the plug substance 58 into the fractures 52 previously formed in the zone 38*a*. This step 82 may be essentially combined with the previous step 80, or it may not be performed if the plug substance 58 can successfully plug off the zone 38*a* by filling the perforations 42, or by filling the perforations and a section of the wellbore 14.

In step 84, the perforating assembly 22 is repositioned, so that it is at the next zone 38*b* to be perforated and fractured. Steps 74-82 can then be repeated as desired for that zone 38*b*. Similarly, these steps 74-84 can be repeated (step 86) for as many zones as desired.

Note that it is not necessary for the perforating assembly 22 to be positioned at the first zone 38*a* immediately before it is repositioned to the next zone 38*b*. In some examples, the perforating assembly 22 may be displaced to various positions between fracturing operations (for example, while flushing the wellbore 14, while flowing the plug substance 58 to the perforations 42, etc.).

In step 88, the zones 38*a-d* are unplugged, so that fluid can flow from the zones into the wellbore 14. The unplugging operation can be performed simultaneously or individually for the various zones 38*a-d*.

The unplugging operation may involve flowing the unplugging substance 60 to the various zones 38*a-d*, in order to disperse, dissolve, remove, break, liquefy or degrade the plug substance 58, or to otherwise cause the flow of fluid from the zones 38*a-d* to the wellbore 14 to be relatively unimpeded. Note that the plug substance 58 could degrade, disperse, liquefy, etc., due to passage of time, exposure to elevated temperature, or otherwise without a need to contact the plug substance with any unplugging substance, in which case it may not be necessary to introduce the unplugging substance into the wellbore 14.

Figure 12:
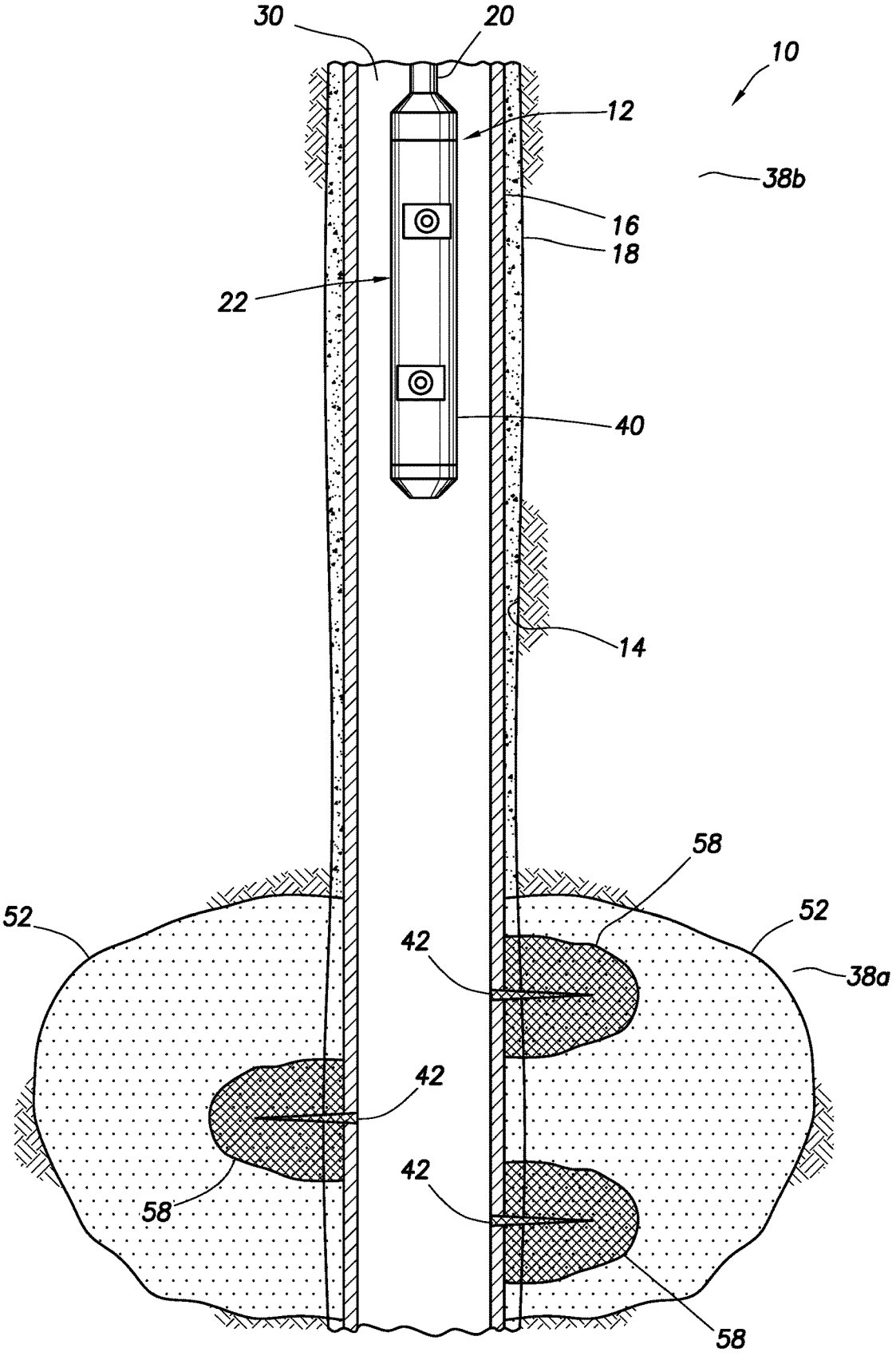
FIG. 12 is a representative partially cross-sectional view of another example of the system and method, in which the perforator is displaced upward only after the plug substance is delivered to the perforations.

Referring additionally now to FIG. 12, another example of the system 10 and method 70 is representatively illustrated. In this example, the perforating assembly 22 is displaced upward (toward the surface along the wellbore 14) after fluid communication from the wellbore to the zone 38*a* (or another zone) is substantially prevented in the plugging operation.

The perforating assembly 22 may be displaced to a position above the perforations 42 only after the plugging operation is concluded, or the perforating assembly may be displaced upward during the plugging operation (e.g., while the plug substance 58 is still being flowed, but after fluid communication from the wellbore 14 to the zone 38*a* is substantially prevented).

As depicted in FIG. 12, the plug substance 58 does not fill the wellbore 14 adjacent the zone 38*a*, but in other examples the plug substance could accumulate in the wellbore adjacent the zone being plugged. The plug substance 58 may accumulate in the wellbore 14 adjacent the zone 38*a* before, during and/or after upward displacement of the perforating assembly 22.

Figure 13:
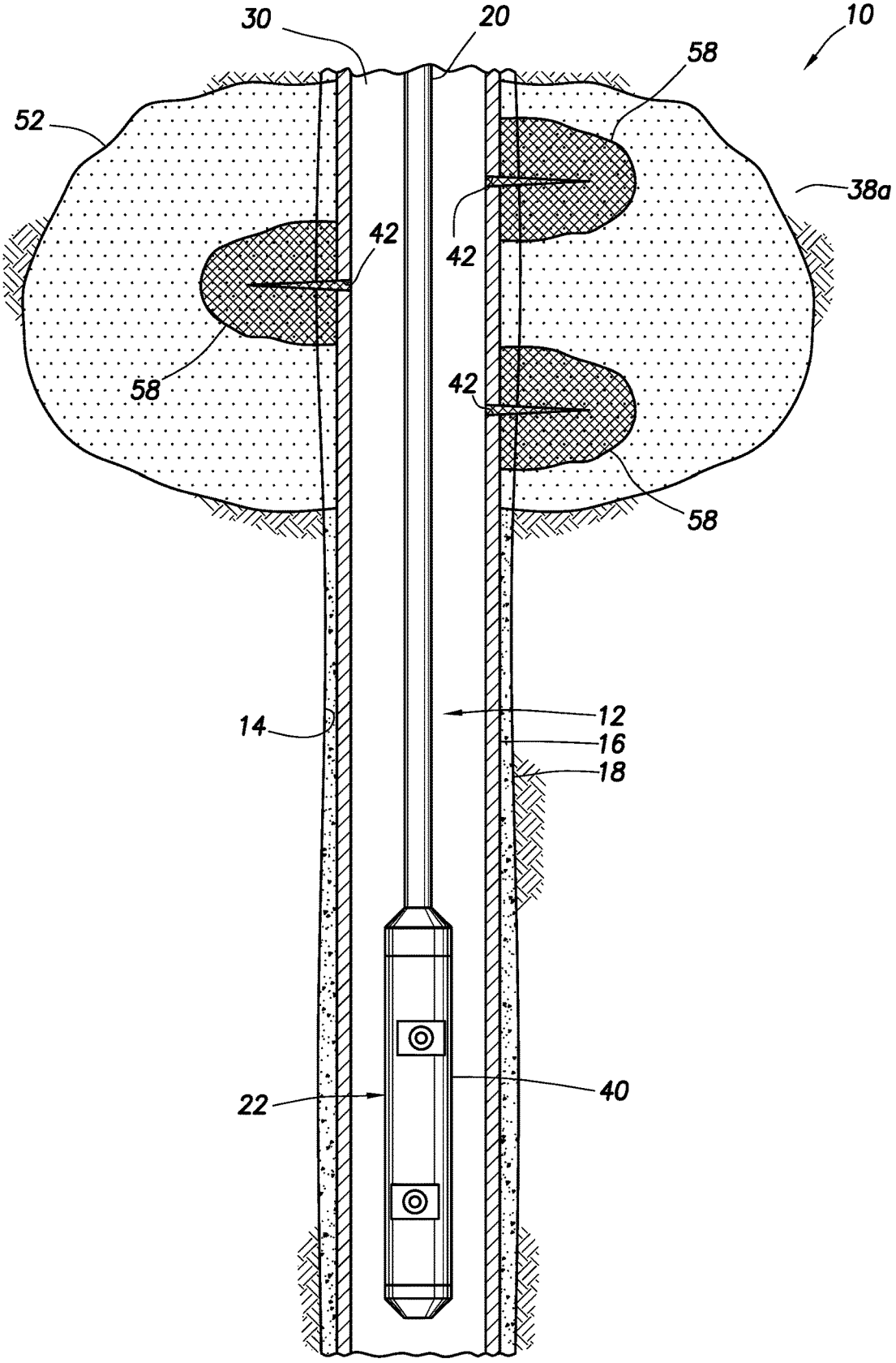
FIG. 13 is a representative partially cross-sectional view of another example of the system and method, in which the perforator is displaced downward after the perforating operation.

Referring additionally now to FIG. 13, yet another example of the system 10 and method 70 is representatively illustrated. In this example, the perforating assembly 22 is displaced downward (away from the surface along the wellbore 14) after the perforating operation, but before the fracturing and plugging operations for the zone 38*a* (or another zone).

As depicted in FIG. 13, the perforating assembly 22 is positioned below the perforations 42 after the perforations are formed. The fracturing operation may be commenced during or after the displacement of the perforating assembly 22 to this position. The wellbore 14 may be flushed after the fracturing operation, while the perforating assembly 22 is positioned below the perforations 42.

The plugging operation in this example is performed while the perforating assembly 22 is positioned below the perforations 42. As depicted in FIG. 13, the plug substance 58 does not fill the wellbore 14 adjacent the zone 38*a*, but in other examples the plug substance could accumulate in the wellbore adjacent the zone being plugged. The perforating assembly 22 may be displaced upward (for example, toward a position adjacent the next zone 38*b* to be perforated) before, during and/or after conclusion of the plugging operation.

It may now be fully appreciated that the above disclosure provides significant advancements to the art of well completions. The system 10 and method 70 examples described above do not require time-consuming packer or bridge plug setting, testing and releasing operations, but provide for convenient and reliable perforating, fracturing and plugging operations to be performed for multiple zones 38*a-d* in a single trip into the wellbore 14. However, one or more packers and/or bridge plugs may be used in systems and methods incorporating the principles of this disclosure, if desired.

The system 10 and method 70 may be particularly useful in wells where a casing patch, nipple, fracturing sleeve valve, ball seat, baffle or other type of restriction is present in the casing 16 above the zones 38*a-d* to be perforated and fractured, since it can be impossible or very difficult to convey packers or bridge plugs past such restrictions.

The system 10 and method 70 may be particularly useful in wells where the casing 16 has different inner diameters at the various zones 38*a-d* to be perforated and fractured, since a typical packer or bridge plug can only seal against a particular range of casing inner diameters. Additional trips into the wellbore 14 might otherwise be needed to change out a typical packer or bridge plug for each different casing inner diameter.

The system 10 and method 70 may be particularly useful in wells having existing perforations, open valves connected in the casing, etc., permitting fluid communication between the formation 38 and the interior of the casing 16. In such cases, the existing perforations, open valves, etc., can be plugged (for example, using the plug substance 58) prior to perforating and fracturing a first one of the zones 38*a-d*.

A well completion system 10 and method is described above, in which a perforating assembly 22 is displaced upward to a next zone in succession only after fluid communication from a wellbore 14 to an immediately previously perforated zone is substantially prevented. The perforating assembly 22 may be displacing upward or motionless while a plugging operation concludes.

A well completion system 10 and method is described above, in which a perforating assembly 22 is displaced downward after perforating a zone, and the perforating assembly remains below perforations 42 of the zone while the zone is fractured and then fluid communication from a wellbore 14 to the zone is substantially prevented. The perforating assembly 22 may be displacing downward or motionless while a fracturing operation commences. The perforating assembly 22 may be displacing upward or motionless while a plugging operation concludes.

A well completion method is provided to the art by the above disclosure. In one example, the method can comprise, in a single trip into a wellbore 14, the following steps being performed for each of multiple zones 38*a-c* penetrated by the wellbore: a) abrasively perforating the zone with a tubing 20 deployed perforating assembly 22, b) fracturing the perforated zone with flow from surface via a well annulus 30, and c) then plugging the fractured zone with a removable plug substance 58, the perforating assembly 22 displacing in the wellbore 14 while the fractured zone is being plugged.

The plug substance 58 may be delivered in each plugging step to the fractured zone 38*a-c* via at least one of an abrasive perforator 40, a downhole valve 62 and the well annulus 30.

The method can include allowing production flow from the multiple zones 38*a-c* after a last plugging step. The step of allowing production flow may include at least one of: dissolving the plug substance 58, dispersing the plug substance 58, flowing a breaker to contact the plug substance 58, allowing a breaker to liquefy the plug substance 58, flowing an acid to contact the plug substance 58 and removing the plug substance 58.

The method can include displacing the perforating assembly 22 while performing at least one of the following steps: flowing the plug substance 58 into the well, pressurizing the plug substance 58 in the well, flowing the plug substance 58 into the zone 38*a-c*, and flowing an abrasive through the tubing 20.

The plug substance 58 may comprise at least one of: poly-lactic acid, poly-glycolic acid and nylon fibers.

The plug substance 58 can prevent flow into one of the zones 38*a-c* while another of the zones is being fractured.

The method can include displacing the perforating assembly 22 in the wellbore 14 away from the earth's surface after the perforating step and before the fracturing step.

The method may include a step of plugging off a fluid communication between an interior of a casing 16 and a formation 38 external to the casing, prior to performing an initial perforating step. The fluid communication can comprise at least one of an open valve in the casing 16 and existing perforations.

The perforating assembly 22 may be displaced in the wellbore 14 toward the earth's surface to a next one of the zones 38*a-c* in succession only after flow from the wellbore into a previously perforated zone is substantially prevented. The perforating assembly 22 in this example either displaces in the wellbore 14 toward the earth's surface, or remains motionless, at a conclusion of the plugging step.

The perforating assembly 22 may be displaced in the wellbore 14 away from the earth's surface after the perforating step, and the perforating assembly 22 may remain below perforations 42 of the zone 38*a-c* while the zone is being fractured, and while fluid communication from the wellbore 14 to the zone is substantially prevented in the plugging step.

The perforating assembly 22 can either displace in the wellbore 14 away from the earth's surface, or remain motionless, while the plugging step commences. The perforating assembly 22 may displace in the wellbore 14 toward the earth's surface, or remain motionless, at a conclusion of the plugging step.

A fracturing fluid 50 may be flowed to the zone 38*a-c* via a well annulus 30 in the fracturing step. The wellbore 14 can be flushed prior to the zone 38*a-c* being plugged in the plugging step.

Pressure may be applied to the wellbore 14, thereby forcing the plug substance 58 into the zone 38*a-c* in the plugging step. The pressure can be applied via a well annulus 30 or via a tubular string 12 used to convey the perforating assembly 22 in the wellbore 14.

The plug substance 58 can comprise at least one of calcium carbonate, gel and sand. The plug substance 58 may include a combination of calcium carbonate and gel.

A restriction may be present in a casing 16 above the zones 38*a-c*. The restriction may prevent conveyance of a packer or bridge plug to the zones 38*a-c*. An inner diameter D of a casing 16 at a first one of the zones 38*a-c* could be different from an inner diameter of the casing at a second one of the zones that is perforated and fractured in the single trip into the wellbore 14.

Another well completion method is provided to the art by the above disclosure. In one example, the method can comprise, in a single trip into a wellbore 14, the following steps being performed for each of multiple zones 38*a-c* penetrated by the wellbore: a) perforating the zone using an abrasive perforator 40, b) then displacing the perforator 40 in the wellbore 14 away from the earth's surface, c) then fracturing the zone 38*a-c*, and d) plugging the fractured zone 38*a-c* with a flowable plug substance 58.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A well completion method, comprising:

in a single trip into a wellbore, the following steps being performed for each of multiple zones penetrated by the wellbore:

a) perforating the zone using an abrasive perforator;

b) then displacing the perforator in the wellbore away from the earth's surface;

c) then fracturing the zone; and d) plugging the fractured zone with a flowable plug substance, wherein the plug substance is flowed to the zone via at least one of the group consisting of the abrasive perforator and a tubing used to convey the abrasive perforator in the wellbore.

2. The method of claim 1, wherein pressure is applied to the wellbore, thereby forcing the plug substance into the zone in step d.

3. The method of claim 1, further comprising allowing fluid to flow from the zone into the wellbore by performing at least one of the group consisting of removing the plug substance, dissolving the plug substance, breaking the plug substance, liquefying the plug substance, flowing an acid to contact the plug substance and dispersing the plug substance.

4. The method of claim 1, wherein the plug substance comprises at least one of the group consisting of calcium carbonate, gel, sand and a combination of calcium carbonate and gel.

5. The method of claim 1, wherein the plug substance comprises at least one of the group consisting of poly-lactic acid, poly-glycolic acid and nylon fibers.

6. The method of claim 1, wherein the plug substance prevents flow into one of the zones while another of the zones is being fractured.

7. The method of claim 1, wherein the abrasive perforator is displaced while at least one of the following steps is performed:

flowing the plug substance into the well, pressurizing the plug substance in the well, flowing the plug substance into the zone in step d and flowing an abrasive through a tubular string that conveys the abrasive perforator in the well.

8. The method of claim 1, wherein a restriction is present in a casing at a location closer to the earth's surface than the zones, the restriction preventing conveyance of a packer or bridge plug to the zones.

9. The method of claim 1, wherein the perforator is displaced in the wellbore toward the earth's surface to a next one of the zones in succession only after flow from the wellbore into a previously perforated zone is substantially prevented.

10. The method of claim 9, wherein, at a conclusion of step d, the perforator either displaces in the wellbore toward the earth's surface, or remains motionless.

11. The method of claim 1, wherein the perforator remains farther from the earth's surface than perforations of the zone while the zone is fractured in step c, and while fluid communication from the wellbore to the zone is substantially prevented in step d.

12. The method of claim 1, wherein, while step d commences, the perforator either displaces in the wellbore away from the earth's surface, or is motionless, and wherein, at a conclusion of step d, the perforator displaces in the wellbore toward the earth's surface, or is motionless.

13. The method of claim 1, wherein step d comprises displacing the perforator in the wellbore while the fractured zone is being plugged.

* * * * *